US006082584A

United States Patent [19]

Stern

[11] Patent Number: 6,082,584

[45] Date of Patent: Jul. 4, 2000

[54] PACKAGE METHOD FOR THE MANUFACTURE THEREOF AND COUPLING THEREFOR

[75] Inventor: Leif Einar Stern, Strandvägen, Sweden

[73] Assignee: Asept International AB, Lund, Sweden

[21] Appl. No.: 09/161,099

[22] Filed: Sep. 25, 1998

[30] Foreign Application Priority Data

Sep. 29, 1997 [SE] Sweden ..... 9703497

[51] Int. Cl.[7] ..... B65D 77/06; B67D 3/00

[52] U.S. Cl. ..... 222/83; 222/81; 222/90; 222/107

[58] Field of Search ..... 222/81, 83, 83.5, 222/88–90, 105, 107, 569, 570

[56] References Cited

U.S. PATENT DOCUMENTS

| | | | |
|---|---|---|---|
| 2,732,017 | 1/1956 | Fleming | 222/83 |
| 3,081,911 | 3/1963 | Scholle | 222/107 |
| 3,884,387 | 5/1975 | Vannucci | 222/83 |
| 4,076,147 | 2/1978 | Schmit | 222/89 |
| 4,314,654 | 2/1982 | Gaubert | 222/83 |
| 4,337,769 | 7/1982 | Olson . | |
| 4,484,697 | 11/1984 | Fry, Jr. | 222/95 |
| 4,562,940 | 1/1986 | Asphar | 222/88 |
| 4,603,793 | 8/1986 | Stern | 222/105 |
| 4,679,705 | 7/1987 | Hamilton | 222/90 |
| 4,776,488 | 10/1988 | Gurzan | 222/81 |
| 5,042,690 | 8/1991 | O'Meara | 222/83 |
| 5,407,099 | 4/1995 | Heuke et al. | 222/83 |
| 5,551,606 | 9/1996 | Rai et al. | 222/460 |
| 5,730,327 | 3/1998 | Stern | 222/82 |

FOREIGN PATENT DOCUMENTS

| | | |
|---|---|---|
| 0162417 | 11/1985 | European Pat. Off. . |
| 0229493 | 7/1987 | European Pat. Off. . |
| 4021743 | 1/1992 | Germany . |
| 4115126 | 6/1992 | Germany . |
| 1104359 | 2/1968 | United Kingdom . |
| 2179526 | 3/1987 | United Kingdom . |
| 81/01992 | 7/1981 | WIPO . |
| 9200895 | 1/1992 | WIPO . |

*Primary Examiner*—J. Casimer Jacyna
*Attorney, Agent, or Firm*—Tarolli, Sundheim, Covell, Tummino & Szabo L.L.P.

[57] ABSTRACT

The present invention relates to a package having a flexible wall and containing liquid products. The invention also relates to a method for manufacturing the package and a coupling therefor. A perforation means (6) for making a hole in the flexible wall (3) is provided not to make a hole in said wall when an inner and an outer coupling device (4, 5) are interconnected but make a hole (7) in the flexible wall (3) after said interconnection of the inner and outer coupling devices (4, 5).

26 Claims, 3 Drawing Sheets

PACKAGE METHOD FOR THE MANUFACTURE THEREOF AND COUPLING THEREFOR

BACKGROUND OF THE INVENTION

The present invention relates to a package having a flexible wall and adapted for liquid products, preferably foodstuff in liquid form, whereby an inner coupling device is provided within unopened portions of the flexible wall, whereby the inner coupling device and an outer coupling device are connectable to each other and whereby the outer coupling device includes a perforation means for making a hole in said unopened portions of the flexible wall such that the liquid product can he discharged from the package through said hole. The invention also relates to a method for manufacturing said package and a coupling therefor.

U.S. Pat. No. 4,603,793 relates to a package of flexible wall material and an inner as well as an outer coupling device. At this package, perforation of the flexible wall is carried through simultaneously with the interconnection of the coupling devices. This normally functions well, but leakage may occur at certain flexible wall materials during the connection/perforating step.

SUMMARY OF THE INVENTION

The object of the present invention has been to provide a package with improved opening possibilities. This is arrived at by providing the package according to the invention with the characterizing features of subsequent claim 1.

The invention also includes a method for manufacturing said package and a coupling for said package.

Since no holes are made in the flexible wall of the package when the outer and inner coupling devices are connected to each other, it is seen to that no portions of the content of the package can flow or run out of the package. First when this liquid tight coupling has been established, perforation of the flexible wall of the package may occur in a simple and effective manner.

BRIEF DESCRIPTION OF THE DRAWINGS

The invention will be further described below with reference to the accompanying drawings, in which.

DESCRIPTION OF PREFERRED EMBODIMENT

Figure 1:
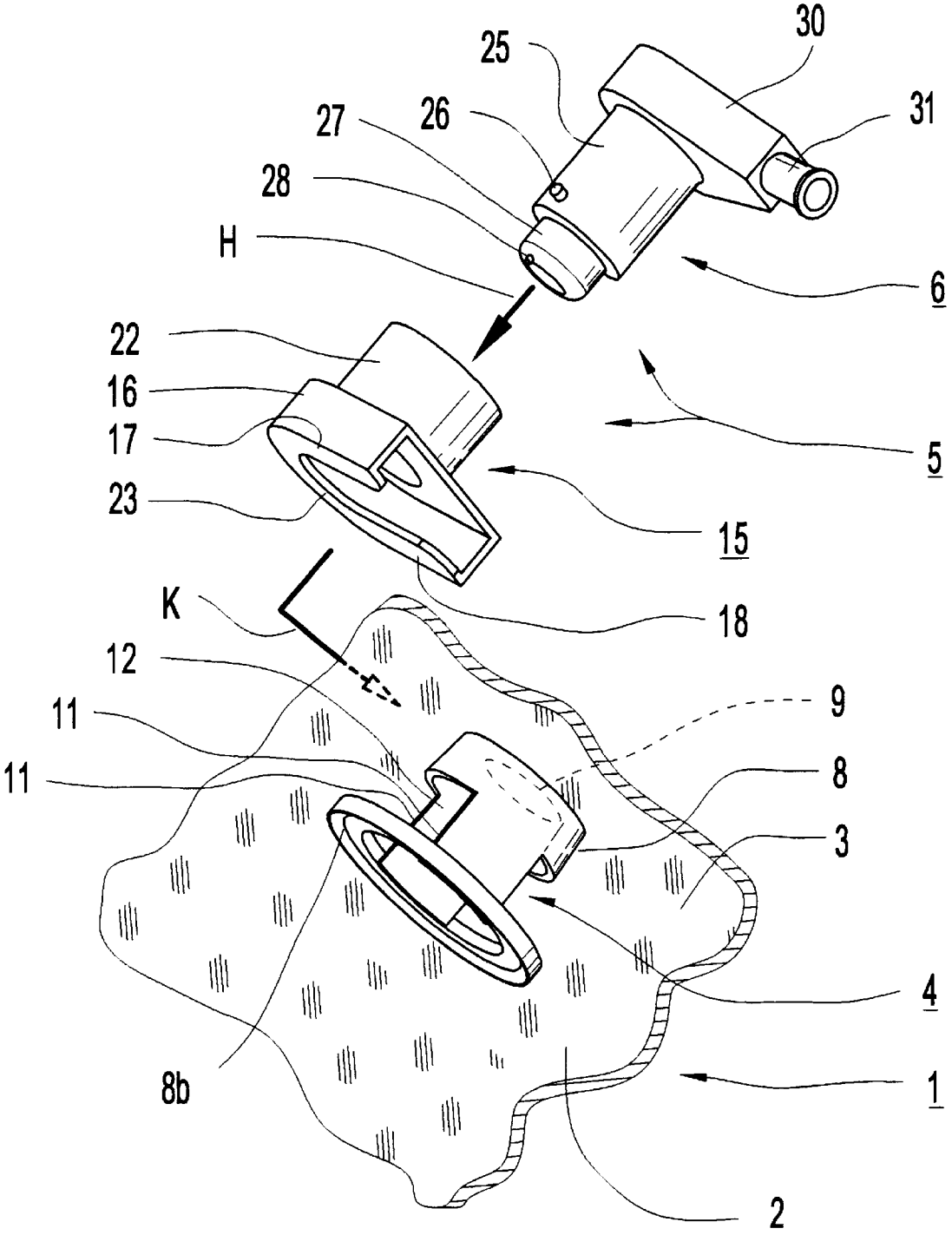
FIG. 1 is a perspective view of members of the package according to the invention.

In the drawings, there is shown a package 1 for liquid products 2, preferably foodstuff in liquid form such as beverages of low viscosity and more viscous foodstuff such as ketchup, mustard and sauces. The package 1 has flexible walls 3 of plastic material, i.e. it is of plastic bag type. Inside the package 1 there is provided an inner coupling device 4 to which an outer coupling device 5 can be connected through the flexible wall 3.

The outer coupling device 5 has a perforation means 6 for making a hole 7 in the flexible wall 3 so that the product 2 can be removed or discharged from the package 1 through the inner coupling device 4, said hole 7 and the outer coupling device 5.

The perforation means 6 is provided not to make the hole 7 in the flexible wall 3 when said inner and outer coupling devices 4, 5 are interconnected, but may be used for making said hole 7 during a perforating step after said interconnection.

The inner coupling device 4 may include an inner coupling member 8 in the form of a first annular member 8*a* with an opening 9. This first annular member 8*a* may be located at or next to the inner side of the flexible wall 3 and the inner coupling device 4 may also include a second annular member 8*b* and said annular members 8*a*, 8*b* may be connected to two or more connection members 11 with intermediate openings 12.

The connection members 11 extend in an axial direction relative to the inner coupling device 4 and the inner coupling member 8 has retaining members 13, 14 which protrude radially in opposite directions relative to the connection members 11.

The outer coupling device 5 also includes a coupling means 15 which may be connected to the inner coupling device 4 without opening the flexible wall 3 and so that said wall will lie between the coupling means 15 and the inner coupling member 8 of the inner coupling device 4.

To permit said connection between the coupling means 15 and the inner coupling device 4, the coupling means 15 includes preferably an outer coupling member 16 with a substantially U-shaped cross section and with two retaining members 17, 18 which are directed towards each other in a radial direction relative to the coupling member 16. The inner coupling member 8 of the inner coupling device 4 is designed to fit into the outer coupling member 16 so that a space for unopened portions of the flexible wall 3 is defined between the inner and outer coupling members 8, 16.

During connection of the coupling means 15 and the inner coupling device 4 to each other, the coupling means 15 is located such that its outer coupling member 16 engages the flexible wall 3 beside the inner coupling device 4. Thereafter, the flexible wall 3 with the coupling means 15 is pressed in and the coupling means 15 displaced in a radial connecting direction K towards the inner coupling device 4 until the retaining members 17, 18 of the coupling means 15 and portions 19, 20 of the flexible wall 3 are situated within the retaining members 13, 14 on the inner coupling member 8 of the inner coupling device 4. With this displacement of the coupling means 15 relative to the inner coupling device 4, the outer coupling member 16 of said coupling means 15 is brought to stick to the inner coupling member 8 of the inner coupling device 4 through said intermediate portions 19, 20 of the flexible wall 3. After said interconnection the flexible wall 3 will thus be situated in said space between the coupling means 15 and the inner coupling device 4, whereby unopened portions 21 of said wall cover the opening 9 in the inner coupling member 8.

Figure 2:
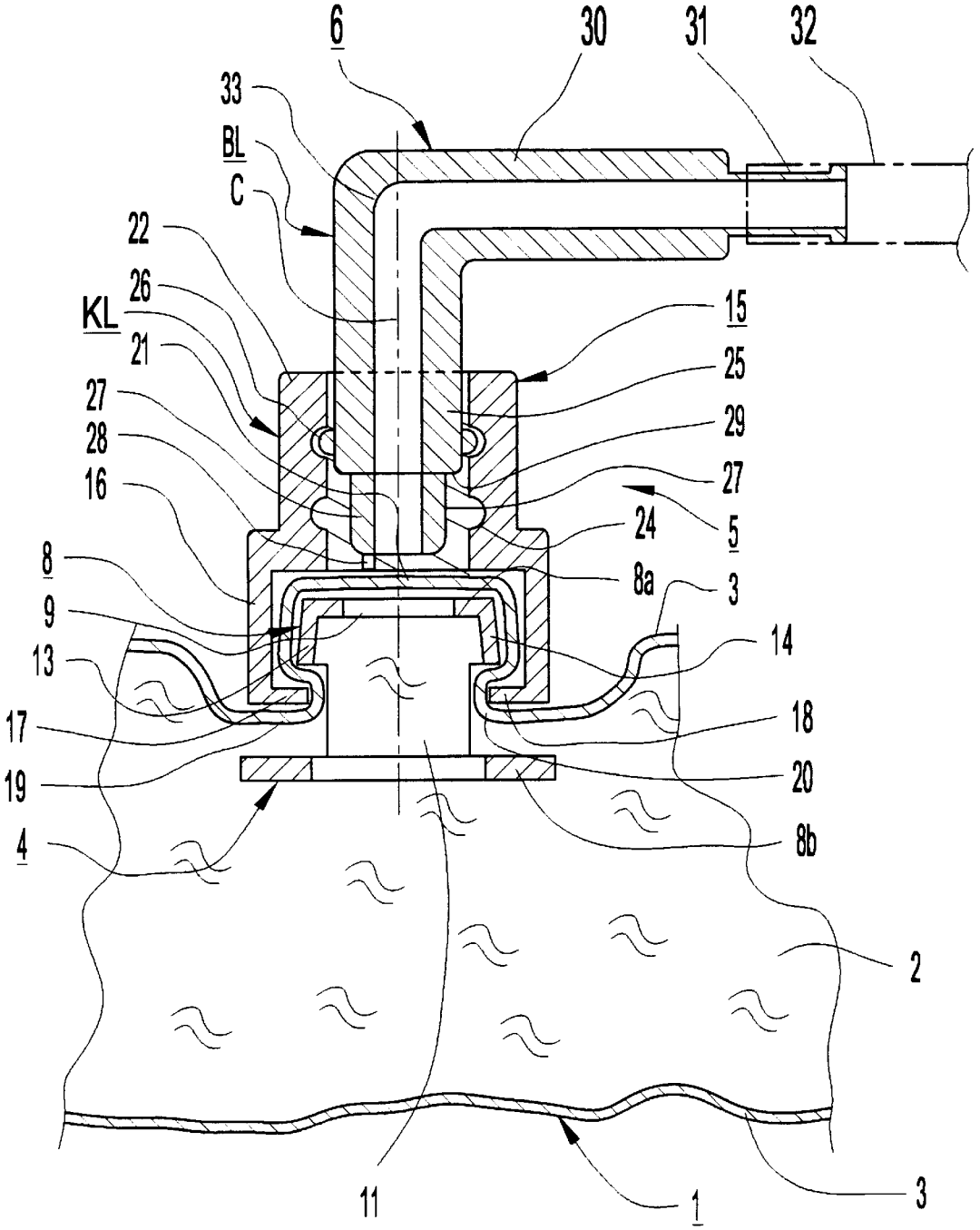
FIG. 2 is a section through the members of FIG. 1, whereby the package is unopened.

The coupling means 15 also includes a centering member 22 for holding the perforation means 6 in a centered position relative to the opening 9 in the inner coupling device 4. This centering is easily established since the coupling means 15 has a stop member 23 which prevents further displacement of the coupling means 15 relative to the inner coupling device 4 when the centering member 22 has reached its predetermined position KL (see FIG. 2) relative to the opening 9 while the stop member 23 through the flexible wall 3 abuts the inner coupling device 4.

The centering member 22 of the coupling means 15 has inner threads 24 and a member 25 of the perforation means 6 engaging the centering member 22 has one or more outwardly directed portions 26. The outwardly directed portions 26 mesh with the inner threads 24 such that the perforation means 6 is guided from a stand-by position BL in a perforating direction H to a perforating position HL for making a hole in the portions 21 of the flexible wall 3 when said perforation means 6 is pivoted or rotated relative to the centering member 22.

Figure 3:
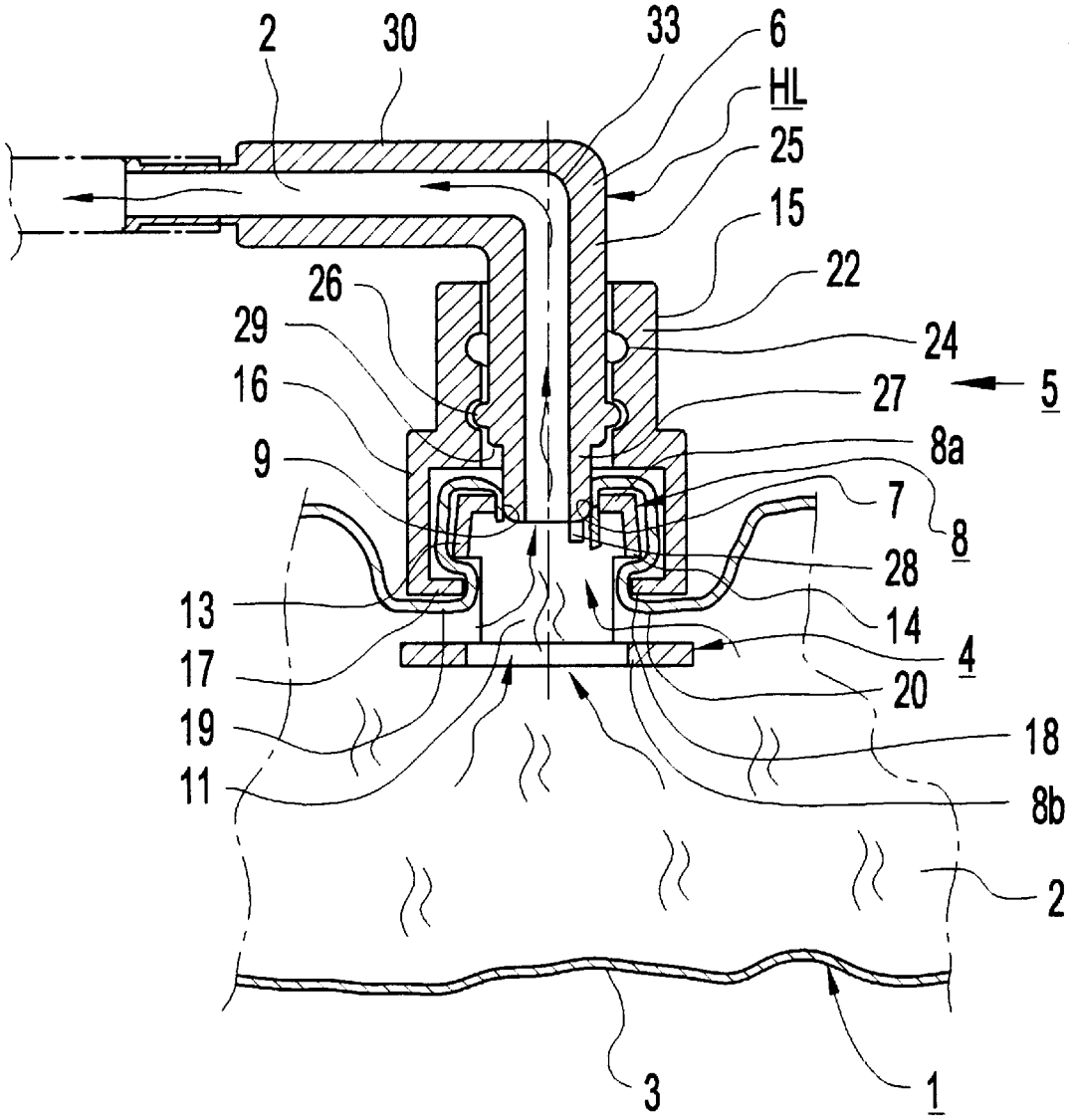
FIG. 3 is a section through the members of FIG. 1, whereby the package is opened.

The inner threads 24 of the coupling means 15 preferably have such pitch that the perforation means 6 is pivotable or rotatable less than one turn from the stand-by position BL (see FIG. 2) to the perforating position HL (see FIG. 3).

The perforation means 6 preferably includes a perforation member 27 which during or after perforation of the portions 21 of the flexible wall 3 can penetrate into the opening 9 in the inner coupling device 4. Said perforation member 27 preferably includes at least one axially outwardly directed perforation element 28 which is adapted to make a hole in the portions 21 of the flexible wall 3 when the perforation means 6 is pivoted or rotated relative to these portions 21 about a centre line C which extends axially relative to the two coupling device 4, 5 when they are interconnected.

The perforation means 6 further includes an edge 29 which is adapted to limit its depth of penetration into the opening 9 after perforation of the flexible wall 3. Furthermore, the perforation means 6 may also have a radially sideways directed twist grip 30 with a connecting portion 31 for a hose 32 as well as a through-flow passage 33, such that the liquid product 2 can flow from the package 1 through the opened hole 7 and the through-flow passage 33 to the hose 32 and further to e.g. a pump or a valve (not shown) or another dispensing device for dispensing the product 2.

It can also be mentioned that the flexible wall 3 preferably also has such elasticity that it can be stretched or extended without breaking when the outer coupling device 5 is connected to the inner coupling device 4. Additionally, it should be mentioned that the inner coupling device 4 preferably is fixedly attached to the inner side of the flexible wall 3.

The embodiment described above is presented for explaining the invention, not limiting it. Thus, it should be mentioned that it is possible within the scope of the following claims to design the inner and outer coupling devices 4, 5 in other ways than shown and described without loosing the essential functions of connecting said devices to each other and making a hole after said interconnection.

What is claimed is:

1. A package (1) comprising:

a flexible wall (3) defining a chamber for a liquid product (2);

an inner coupling device (4) located in said chamber within unopened portions (21) of said flexible wall (3);

an outer coupling device (5) connectable to said inner coupling device (4) by moving said inner and outer coupling devices (4, 5) in a connecting direction (K) relative to each other; and said outer coupling device (5) penetrating said unopened portions (21) of the flexible wall (3) in a perforating direction (H) for discharging the liquid product (2) from said package (1), said connecting direction (K) being different from said perforating direction (H), said outer coupling device (5) including a coupling means (15) and a perforation means (6), said perforation means (6) being movable relative to said coupling means (15), said coupling means (15) having a connecting position relative to said inner coupling device (4) for locating said flexible wall (3) unbroken between said coupling means (15) and said inner coupling device (4), said perforation means (6) penetrating said flexible wall (3) in said perforating direction (H) when said coupling means (15) is located in said connecting position relative to said inner coupling device (4).

2. The package according to claim 1 wherein said perforation means (6) is rotatable relative to said coupling means (15) for penetrating said flexible wall (3).

3. The package according to claim 1 wherein said coupling means (15) includes a stop member (23) for stopping relative movement between said coupling means (15) and said inner coupling device (4) when said coupling means (15) and said inner coupling device (4) are located in predetermined connecting positions (KL) relative to each other.

4. The package according to claim 1 wherein said coupling means (15) includes an axis (C) and a first pair of retaining members (17, 18), said first pair of retaining members (17, 18) moving in a radial connecting direction (K) relative to said inner coupling device (4), said first pair of retaining members (17, 18) and folded portions (19, 20) of said flexible wall (3) being within a second pair of retaining members (13, 14) of said inner coupling device (4) until said first pair of retaining members (17, 18) of said coupling means (15) and said folded portions (19, 20) of said flexible wall (3) are positioned within said second pair of retaining members (13, 14) of said inner coupling device (4); said perforation means (6) penetrating unopened portions (21) of said flexible wall (3) by movement relative to said inner coupling device (4) in an axial perforating direction (H).

5. The package according to claim 4 wherein said coupling means (15) includes an outer coupling member (16) with a substantially U-shaped cross section, said inner coupling device (4) having an inner coupling member (8) for fitting into said outer coupling member (16), said inner and outer coupling members (8, 16) defining a space therebetween for folding said portions (19, 20) of said flexible wall (3).

6. The package according claim 1 wherein said inner coupling device (4) has an opening (9) covered by unopened portions (21) of said flexible wall (3), said outer coupling device (5) including a centering member (22) for centering said perforation means (6) relative to said opening (9) when said outer coupling device (5) is located in a connecting position (KL) relative to said inner coupling device (4), said perforation means (6) penetrating said unopened portions (21) of said flexible wall (3).

7. The package according to claim 1 wherein said coupling means (15) and said inner coupling device (4) include folded portions (19, 20) of said flexible wall (3), said folded portions (19, 20) conforming to a space between said coupling means (15) and said inner coupling device (4) during interconnection of said coupling means (15) and said inner coupling device (4).

8. The package according to claim 1 wherein said inner coupling device (4) has a first annular member (8*a*), a second annular member (8*b*), and connection members (11) therebetween, said first annular member (8*a*) located near an inner side of the flexible wall (3), said first annular member (8*a*) defining an outer coupling member with a first pair of retaining members (13, 14), said first pair of retaining members (13, 14) protruding radially outwards in opposite directions relative to said connection members (11), said outer coupling device (5) having a second pair of retaining members (17, 18) protruding radially inwards in opposite directions relative to said outer coupling device (5), said inner and outer coupling devices (4, 5) being connectable to each other through unopened portions (21) of said flexible wall (3) by engagement of said first pair of retaining members (13, 14) with said second pair of retaining members (17, 18).

9. The package according to claim 1 wherein said perforation means (6) is positioned on said coupling means (15) for rotating about a center line (C), said center line (C) extending in an axial direction through said inner and outer coupling devices (4, 5) when said devices (4, 5) are interconnected, said perforation means (6) rotating about said center line (C) for penetrating unopened portions (21) of said flexible wall (3) and making a hole (7) therein.

10. The package according to claim 9 wherein said perforation means (6) rotates less than one turn when said perforation means (6) moves from a stand-by position (BL) to a perforating position (HL).

11. The package according to claim 9 wherein said perforation means (6) includes a perforation member (27) for penetrating an opening (9) in said inner coupling device (4), said perforation member (27) having at least one axially outwardly directed perforation element (28) for making a hole (7) in said flexible wall (3) as said perforation means (6) is rotated.

12. The package according to claim 9 wherein said outer coupling device (5) includes a centering member (22) with inner threads (24), said centering member (22) centering said perforation means (6) relative to an opening (9) in said inner coupling device (4), said centering member (22) having one or more outwardly directed portions (26) which mesh with said inner threads (24), said inner threads (24) and said portions (26) meshing therewith and guiding said perforation means (6) from a stand-by position (BL) to a perforating position (HL), said perforation means (6) making a hole (7) in said flexible wall (3) when said perforation means (6) is rotated relative to said centering member (22).

13. Package according to claim 9 wherein said perforation means (6) includes a trough-flow passage (33) for permitting through-flow of the liquid product (2) out of said package (1) through said hole (7).

14. The package according to claim 1 wherein said perforation means (6) includes an edge (29) for limiting the depth of penetration of said perforation means (6) into said inner coupling device (4).

15. The package according to claim 1 wherein said perforation means (6) includes a twist grip (30), said twist grip (30) being directed sideways in a radial direction relative to an axial centre line (C), said twist grip (30) including a connecting portion (31) for a hose (32) through which the liquid product (2) can be fed from a through-flow passage (33) in said perforation means (6).

16. The package according to claim 1 wherein said flexible wall (3) has a predetermined elasticity for maintaining containment of the liquid product (2) when said inner coupling device (4) is interconnected with said outer coupling device (5).

17. The package according to claim 1 wherein said inner coupling device (4) is fixedly attached to an inner side of said flexible wall (3).

18. A method for manufacturing a package (1) for a liquid product (2), said method comprising the steps of:

providing an inner coupling device (4) within unopened portions (21) of a flexible wall (3);

connecting a coupling means (15) of an outer coupling device (5) to said inner coupling device (4) in a connecting direction (K) such that said unopened portions (21) of said flexible wall (3) are located between said coupling means (15) and said inner coupling device (4); and penetrating said unopened portions (21) of said flexible wall (3) with said outer coupling device (5) in a perforating direction (H) such that the liquid product (2) can be discharged from the package (1), said connecting direction (K) being different from said perforating direction (H), said penetrating step including the step of displacing a perforation means (6) relative to said coupling means (15) in said perforating direction (H).

19. The method according to claim 18 further including the steps of:

connecting said outer coupling device (5), having an axis (C), through said unopened portions (21) of said flexible wall (3), with said inner coupling device (4) by laterally displacing said outer coupling device (5) in a radial connecting direction (K) until said coupling devices (4, 5) are located in predetermined connecting positions (KL) relative to each other; and displacing said perforation means (6) in an axial perforating direction (H) such that said perforation means (6) makes a hole (7) in said unopened portions (21).

20. The method of claim 18 further comprising the steps of:

rotating said perforation means (6) about an axis (C) relative to said coupling means (15); and said perforation means making a hole (7) in said flexible wall (3).

21. A coupling for a package (1) containing a liquid product, said coupling comprising:

an inner coupling device (4);

a flexible wall (3) defining a chamber with unopened portions (21); and an outer coupling device (5) connectable to said inner coupling device in a connecting direction (K), said outer coupling device (5) penetrating said unopened portions (21) of said flexible wall (3) in a perforating direction (H) for discharging the liquid product (2) from the package (1), said connecting direction (K) being perpendicular to said perforating direction (H), said outer coupling device (5) including a coupling means (15) and a perforation means (6) movable relative to said coupling means (15), said coupling means (15) located in a connecting position relative to said inner coupling device (4), said flexible wall (3) being unbroken between said coupling means (15) and said inner coupling device (4), said perforation means (6) penetrating said flexible wall (3) in said perforating direction (H) when said coupling means (15) is located in said connecting position relative to said inner coupling device (4).

22. The coupling according to claim 21 wherein said perforation means (6) is rotatable about an axis (C) relative to said coupling means (15) for penetrating said flexible wall (3) in said perforating direction (H) after interconnection of said coupling means (15) and said inner coupling device (4).

23. The coupling according to claim 21 wherein said coupling means (15) includes an axis (C) and a first pair of retaining members (17, 18) for moving in a radial connecting direction (K) relative to said inner coupling device (4), said first pair of retaining members (17, 18) and folded portions (19, 20) of said flexible wall (3) pressed within a second pair of retaining members (13, 14) of said inner coupling device (4) until said first pair of retaining members (17, 18) and said folded portions (19, 20) are located within said second pair of retaining members (13, 14), said perforation means (6) penetrating unopened portions (21) of said flexible wall (3) by movement of said perforation means (6) relative to said inner coupling device (4) in an axial perforating direction (H).

24. A package (1) comprising:

a flexible wall (3) defining a chamber for a liquid product (2);

an inner coupling device (4) located in said chamber within unopened portions (21) of said flexible wall (3); and an outer coupling device (5) connectable to said inner coupling device (4) by moving said inner and outer coupling devices (4, 5) relative to each other;

said outer coupling device (5) penetrating said unopened portions (21) of said flexible wall (3) for discharging the liquid product (2) from said package (1), said outer coupling device (5) including a coupling means (15) and a perforation means (6), said perforation means (6) being movable relative to said coupling means (15), said coupling means (15) having a connecting position relative to said inner coupling device (4) for locating said flexible wall (3) unbroken between said coupling means (15) and said inner coupling device (4), said perforation means (6) penetrating said flexible wall (3) when said coupling means (15) is located in said connecting position relative to said inner coupling device (4), said inner coupling device (4) having a stop member (23) for stopping relative movement between said coupling means (15) and said inner coupling device (4) when said coupling means (15) and said inner coupling device (4) are located in a connecting position (KL).

25. A package (1) comprising:

a flexible wall (3) defining a chamber for a liquid product (2);

an inner coupling device (4) located in said chamber within unopened portions (21) of said flexible wall (3); and an outer coupling device (5) connectable to said inner coupling device (4) by moving said inner and outer coupling devices (4, 5) relative to each other;

said outer coupling device (5) penetrating said unopened portions (21) of said flexible wall (3) for discharging the liquid product (2) from said package (1), said outer coupling device (5) including a coupling means (15) and a perforation means (6), said perforation means (6) being movable relative to said coupling means (15), said coupling means (15) having a connecting position relative to said inner coupling device (4) for locating said flexible wall (3) unbroken between said coupling means (15) and said inner coupling device (4), said perforation means (6) penetrating said flexible wall (3) when said coupling means (15) is located in said connecting position relative to said inner coupling device (4), said outer coupling device (5) further including a centering member (22) with inner threads (24), said centering member (22) centering said perforation means (6) relative to an opening (9) in said inner coupling device (4), said perforation means (6) being inserted into said opening (9), said perforation means (6) engaging said centering member (22) and having one or more outwardly directed portions (26) which mesh with said inner threads (24), said inner threads (24) and said portions (26) meshing to guide said perforation means (6) from a stand-by position (BL) to a perforating position (HL), said perforation means (6) making a hole (7) in said flexible wall (3) when said perforation means (6) is rotated relative to said centering member (22).

26. A package (1) comprising:

a flexible wall (3) defining a chamber for a liquid product (2);

an inner coupling device (4) located in said chamber within unopened portions (21) of said flexible wall (3); and an outer coupling device (5) connectable to said inner coupling device (4) by moving said inner and outer coupling devices (4, 5) relative to each other;

said outer coupling device (5) penetrating said unopened portions (21) of said flexible wall (3) for discharging the liquid product (2) from said package (1), said outer coupling device (5) including a coupling means (15) and a perforation means (6), said perforation means (6) being movable relative to said coupling means (15), said coupling means (15) having a connecting position relative to said inner coupling device (4) for locating said flexible wall (3) unbroken between said coupling means (15) and said inner coupling device (4), said perforation means (6) penetrating said flexible wall (3) when said coupling means (15) is located in said connecting position relative to said inner coupling device (4), said perforation means (6) including an edge (29) for limiting the depth of penetration of said perforation means (6) into said inner coupling device (4).

* * * * *